US009212540B2

(12) United States Patent
Woiceshyn

(10) Patent No.: US 9,212,540 B2
(45) Date of Patent: Dec. 15, 2015

(54) WELLBORE FLUID TREATMENT AND METHOD

(75) Inventor: Glenn Edward Woiceshyn, Calgary (CA)

(73) Assignee: Absolute Completion Technologies Ltd., Calgary, Alberta (CA)

( * ) Notice: Subject to any disclaimer, the term of this patent is extended or adjusted under 35 U.S.C. 154(b) by 282 days.

(21) Appl. No.: 13/703,331

(22) PCT Filed: Jun. 13, 2011

(86) PCT No.: PCT/CA2011/000698

§ 371 (c)(1), (2), (4) Date: Dec. 10, 2012

(87) PCT Pub. No.: WO2011/153635

PCT Pub. Date: Dec. 15, 2011

(65) Prior Publication Data

US 2013/0075090 A1 Mar. 28, 2013

Related U.S. Application Data

(60) Provisional application No. 61/353,998, filed on Jun. 11, 2010.

(51) Int. Cl.
*E21B 43/08* (2006.01)
*E21B 47/10* (2012.01)

(52) U.S. Cl.
CPC ..... *E21B 43/08* (2013.01); *E21B 47/1015* (2013.01)

(58) Field of Classification Search
CPC . E21B 43/082; E21B 43/086; E21B 47/1015; G01N 33/2882
USPC ..... 166/250.12
See application file for complete search history.

(56) References Cited

U.S. PATENT DOCUMENTS

| | | | |
|---|---|---|---|
| 1,256,830 | A | 2/1918 | Rodrigo, Sr. |
| 1,473,644 | A | 11/1923 | Rodrigo, Sr. |
| 1,488,753 | A | 4/1924 | Kelly |
| 1,750,871 | A | 3/1930 | Wilson |
| 2,391,609 | A | 12/1945 | Wright |

(Continued)

FOREIGN PATENT DOCUMENTS

| | | |
|---|---|---|
| BG | 31730 | 3/1982 |
| CA | 2255071 | 6/1999 |

(Continued)

OTHER PUBLICATIONS

Introduction to STARS Screens, Absolute Engineering Inc., presented prior to Dec. 10, 2003.

(Continued)

*Primary Examiner* — Jennifer H Gay
*Assistant Examiner* — George Gray
(74) *Attorney, Agent, or Firm* — Arent Fox LLP

(57) ABSTRACT

A cartridge-type wellbore screen includes a fluid tracing material carried by the wellbore tubular and mounted at a mounting site spaced from an opening through the screen wall to the screen's inner diameter and outwardly of the inner diameter, the mounting site being positioned such that a fluid flow path is restricted to be from the mounting site, along the outer surface of the screen and through the opening before entering the inner diameter. The screen can be used for treating wellbore fluids.

19 Claims, 4 Drawing Sheets

(56) References Cited

U.S. PATENT DOCUMENTS

| | | | |
|---|---|---|---|
| 2,401,035 | A | 5/1946 | Akeyson et al. |
| 2,540,123 | A | 2/1951 | Kinley |
| 2,798,768 | A | 9/1957 | Babin |
| 2,981,332 | A | 4/1961 | Miller |
| 3,177,945 | A | 4/1965 | Fether |
| 3,213,950 | A | 10/1965 | Ghelfi et al. |
| 3,273,641 | A | 9/1966 | Bourne |
| 3,299,831 | A | 1/1967 | Watson et al. |
| 3,322,199 | A | 5/1967 | Van Note, Jr. |
| 4,706,751 | A | 11/1987 | Gondouin |
| 5,310,000 | A | 5/1994 | Arterbury et al. |
| 5,526,881 | A | 6/1996 | Martin et al. |
| 5,551,513 | A | 9/1996 | Surles et al. |
| 5,636,661 | A | 6/1997 | Moyes |
| 5,664,628 | A | 9/1997 | Koehler |
| 5,711,879 | A | 1/1998 | Carlson |
| 5,816,742 | A | 10/1998 | Cordewener |
| 5,955,144 | A | 9/1999 | Sinclair et al. |
| 6,006,829 | A | 12/1999 | Whitlock |
| 6,012,522 | A | 1/2000 | Donnelly et al. |
| 6,202,750 | B1 | 3/2001 | Ohanesian |
| 6,561,732 | B1 | 5/2003 | Bloomfield et al. |
| 6,645,769 | B2 | 11/2003 | Tayebi et al. |
| 6,702,044 | B2 | 3/2004 | Reddy et al. |
| 6,799,634 | B2 | 10/2004 | Hartog et al. |
| 7,049,272 | B2 | 5/2006 | Sinclair et al. |
| 7,258,166 | B2 | 8/2007 | Russell |
| 7,581,586 | B2 | 9/2009 | Russell |
| 7,861,787 | B2 | 1/2011 | Russell |
| 2001/0042620 | A1 | 11/2001 | Ohanesian |
| 2002/0020527 | A1 | 2/2002 | Kilaas et al. |
| 2004/0084186 | A1 | 5/2004 | Allison |
| 2004/0231845 | A1 | 11/2004 | Cooke, Jr. |
| 2005/0056425 | A1 | 3/2005 | Grigsby et al. |
| 2006/0011345 | A1* | 1/2006 | Delaloye et al. ..... 166/304 |
| 2007/0246212 | A1 | 10/2007 | Richards |
| 2007/0256834 | A1 | 11/2007 | Hopkins et al. |
| 2008/0006402 | A1* | 1/2008 | Russell ..... 166/229 |
| 2011/0024111 | A1* | 2/2011 | Moen et al. ..... 166/278 |
| 2011/0257887 | A1* | 10/2011 | Cooper et al. ..... 702/12 |

FOREIGN PATENT DOCUMENTS

| | | | |
|---|---|---|---|
| DE | 1301300 | | 8/1969 |
| DE | 10031663 | | 8/2001 |
| EP | 1416118 | | 5/2004 |
| FR | 2906561 | B1 | 4/2008 |
| WO | WO 2005/056977 | A1 | 6/2005 |
| WO | WO 2006/004426 | A1 | 1/2006 |
| WO | WO 2011/153635 | A1 | 12/2011 |
| WO | WO 2011/153636 | A1 | 12/2011 |

OTHER PUBLICATIONS

Notification of International Search Report, International Search Report and Written Opinion in International Application No. PCT/CA2011/000698 mailed Aug. 18, 2011.

International Search Report and and Written Opinion mailed Sep. 2, 2011, in International Application No. PCT/CA2011/000699.

Woiceshyn, G. et al., "Mechanical Evaluation of a New Sand Control Screen for SAGD Applications," 2008 SPE International Thermal Operations and Heavy Oil Symposium, Calgary Alberta Canada Oct. 20-23, 2008, Paper No. SPE/PS/CHOA 117486.

* cited by examiner

WELLBORE FLUID TREATMENT AND METHOD

FIELD

The invention relates to wellbore tubulars and, in particular, wellbore tubulars for wellbore fluid treatments.

BACKGROUND

Various wellbore tubulars are known and serve various purposes. A wellbore screen is a tubular including a screen material forming or mounted in the tubular wall. The wellbore screen can be used in wellbores such as those for water, steam injection and/or petroleum product production.

In one form, a wellbore screen is known that includes a wall of screen material held between end fittings. The wall includes screen material that may take various forms and is usually supported in some way, as by a perforated sleeve. These screens filter fluids passing through the screen material layer either into or out of the screen inner diameter.

In another form, a wellbore screen is an apparatus that can include a base pipe and a plurality of filter cartridges supported in the base pipe. The filter cartridges are mounted in openings through the base pipe wall. The filter cartridges screen fluids passing through the openings into the base pipe for pumping or flow up hole. Of course, the openings may be formed and/or employed to also permit flow of fluids outwardly therethrough from the inner diameter of the base pipe.

In situ treatment of produced fluids are of interest as they may take advantage of useful downhole conditions, facilitate fluid handling and avoid disposal of problematic materials at surface. Other downhole fluid treatments may also be of interest, for example, to address problems experienced when injected fluids downhole.

SUMMARY

In accordance with one aspect of the present invention, there is provided a cartridge-type wellbore screen comprising: a cylindrical wall including a first end, a second end opposite the first end, an inner surface defining an inner diameter of the wellbore screen, the inner diameter being open from the first end to the second end, and an outer surface; an opening to the inner diameter through the cylindrical wall the opening extending between the outer surface and the inner surface to provide fluid access from the outer surface to the inner diameter; a fluid filtering material positioned to filter oversize particles from passing through the opening; and a fluid tracing material carried by the wellbore tubular and mounted at a mounting site spaced from the opening to the inner diameter and outwardly of the inner diameter, the mounting site being positioned such that a fluid flow path is restricted to be from the mounting site, along the outer surface and through the opening before entering the inner diameter.

In accordance with another broad aspect, there is provided a method for monitoring fluid production in a well, the well extending from ground surface into a formation, the method comprising: installing cartridge-type wellbore screen in the well, the cartridge-type wellbore screen including a first end, a second end opposite the first end, a cylindrical wall including an inner surface defining an inner diameter of the wellbore screen, the inner diameter being open from the first end to the second end, and an outer surface; an opening through the cylindrical wall providing access between the outer surface and the inner diameter; a fluid filtering material positioned to filter oversize particles from passing through the opening; a fluid tracing material carried by the wellbore tubular and mounted at a mounting site spaced from the opening to the inner diameter and outwardly of the inner diameter, the mounting site being positioned such that a fluid flow path is restricted to be from the mounting site, along the outer surface and through the opening before entering the inner diameter; allowing a flow of a fluid past the fluid tracing material, along the outer surface and through the opening to the inner diameter, the fluid picking up a tracer from the fluid tracing material; allowing the fluid to move through the inner diameter to surface; and monitoring the fluid arriving at surface for the presence of the tracer.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

Drawings are included for the purpose of illustrating certain aspects of the invention. Such drawings and the description thereof are intended to facilitate understanding and should not be considered limiting of the invention. Drawings are included, in which.

DETAILED DESCRIPTION OF VARIOUS EMBODIMENTS

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

Figure 1:
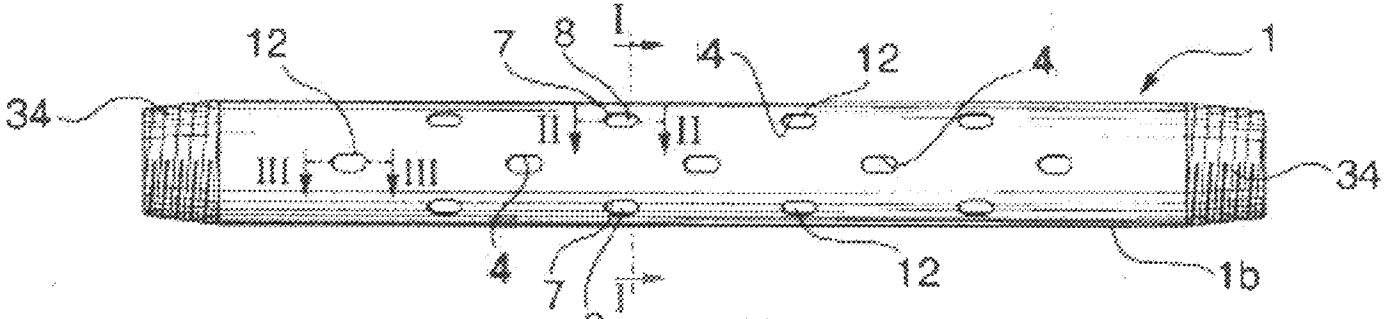
FIG. 1 is a side elevation of a wellbore tubular.
Figure 3:
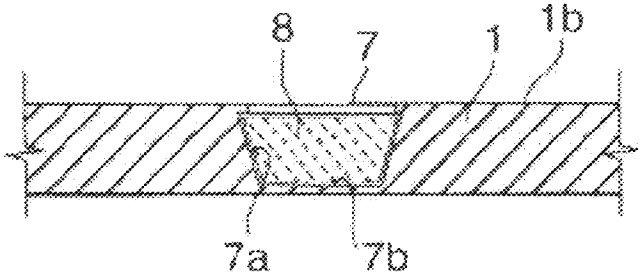
FIG. 3 is a section through a pocket containing fluid tracing material, with reference to line II-II of FIG. 1 for the sectional location thereof.
Figure 2:
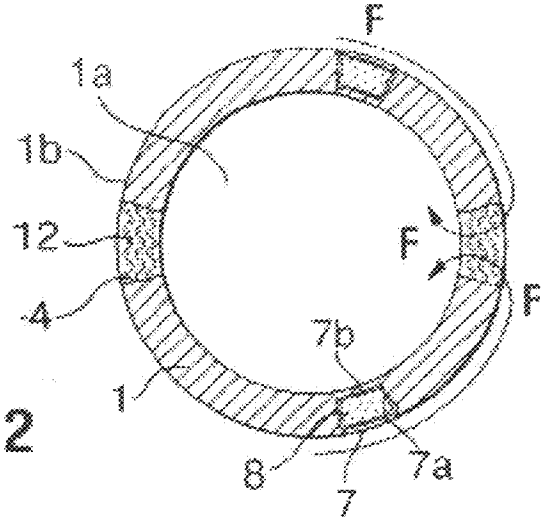
FIG. 2 is a section along line I-I of FIG. 1.

Referring to FIGS. 1 to 3, a wellbore tubular in the form of a cartridge-type screen is shown including a perforated wall with fluid passages therethrough and a fluid tracing material exposed on the outer surface thereof. The wellbore tubular may be formed using various constructions. In the illustrated embodiment, the wellbore tubular includes a perforated tubular wall 1 including an inner surface defining inner diameter 1*a* and an outer surface 1*b*.

The ends 34 of the wellbore tubular may be formed for connection to adjacent wellbore tubulars. As will be appreciated, the tubular's ends may be formed in various ways for connection into a string, such as, for example, by formation at one or both ends as threaded pins (as shown), threaded boxes or other types of connections Inner diameter 1*a* extends from end to end of the tubular such that the tubular can act to convey fluids from end to end therethrough and be used to form a fluid conduit through a plurality of connected tubulars.

The perforations of the tubular's perforated walls are formed by openings formed through the wall. In particular, wall 1 has a plurality of openings 4 therethrough to permit fluid flow between the inner diameter and the outer surface. Depending on the mode of operation intended for the wellbore tubular, fluid flow can be inwardly toward inner diameter 1*a* or outwardly from inner diameter 1*a*.

Being a cartridge-type screen, openings 4 are often circular or ovoid and have a filter cartridge 12 supported in each one. The filter cartridges can permit fluid flow through the openings but include screening materials to act to screen oversize materials from the fluid flow. The cartridges can take many forms, a few of which are described below in relation to FIGS. 5 to 9. Such a screen is durable and is useful in various wellbore operations such as those for water production, water/steam injection, oil and/or gas production, etc.

Such a wellbore tubular has been useful for in-situ treatment of fluid. Particular tubular and methods for in-situ fluid treatment are described in applicants earlier U.S. Pat. No. 7,861,787, dated Jan. 4, 2011. As described in that patent, a wellbore tubular may be selected to carry a chemical treatment material to affect fluid flowing therepast. One chemical treatment material is a material that supplies tracers to the produced fluids. A fluid tracing material, also called a biotracer, is a substrate that carries a unique tracer that is picked up from the substrate by fluid passing thereby, carried to surface with the fluid and can be detected at surface to provide information concerning the well such as type of fluids produced, location of production, etc.

While chemical treatment material including fluid tracing material can be installed throughout the cartridge-type screen, it has been found that the relatively large diameter openings and the proximity of the cartridge material to the inner diameter in the cartridge type screens tends to result in inadvertent tracer contamination in these screens if the material is installed in the openings, wherein fluid passing through a screen, but not actually produced through the openings of the screen, may pick up tracer from that screen. As such the current wellbore tubular has the fluid tracing material on the outer surface spaced from any opening to the inner diameter, such that the fluid tracing material is isolated from fluid passing through the inner diameter and the chance of tracer contamination to fluid simply passing though the tubular is reduced. Tracer must, therefore, be picked up by fluid outside the screen and carried into the inner diameter by passage through openings into the tubular.

In one embodiment, the wellbore tubular, therefore, includes at least one mounting site formed as a pocket 7 on the outer surface 1*b* and a fluid tracing material 8 mounted in the pocket. The pocket is sealed against fluid passage from the pocket to the inner diameter except from the pocket along the outer surface and through the opening. In particular, there is no fluid communication port from the pocket directly to the inner diameter and fluid cannot pass from the inner diameter directly into the pocket. Tracer therefore can diffuse to the produced fluids as it passes along the outer surface and passes though the openings in the screen with the produced fluids to flow up hole.

Pocket 7 includes walls 7*a* encircling and extending up from a floor 7*b* to form an indentation on the outer surface and material 8 is positioned therein such that material 8 is protected from abrasion by walls 7*a*. Pocket 7 may take various forms. For example, it may have various shapes in plan view, and in sectional view. Floor 7*b* may be expansive or effectively a point, such as the apex of a conical indentation. Walls 7*a* may be sloping, radially cut, undercut, etc. Walls 7*a* may initiate at a position flush with the cylindrical curvature of the outer surface or may be raised to protrude slightly from the cylindrical curvature of the outer surface.

To facilitate manufacture, pocket 7 may be formed in an operation similar to the formation of the openings 4. In one embodiment, the openings and the pockets are formed by removing wall material to form a hole in the wall, as by drilling, milling, laser cutting, jetting, etc. The hole of the opening passes fully through the wall from the outer surface to the inner diameter, while the pocket remains closed at its floor end. For example, a pocket can be closed by securing a plug (such as an end wall, a liner, a sealant, etc.) in an opening such that fluid passage therethrough is stopped. Alternately, the wall removal process used to form an opening, can be stopped before the wall thickness is fully penetrated leaving the walls and a closed bottom floor.

Fluid tracing materials are generally solids and may take various forms and be secured in the pocket in various ways. The mode of securement may depend on the form of the fluid tracing material. Fluid tracing material may, for example, be in the form of a unitary body such as a block, a plate, a disc, etc. or may include a plurality of parts such as beads, fibers, etc. In another embodiment, a filter cartridge may be filled with tracer material and acts as a carrier therefor. That cartridge can be installed in an opening through which fluid access to the inner diameter is stopped, such that the tracer in the cartridge cannot contaminate fluid passing through the inner diameter. As noted above, that opening can be plugged such as by provision of an end wall, a liner, a sealant, etc. such that fluid passage therethrough is stopped.

Understanding that the fluid tracing material may take many forms, it will be appreciated then that the material may be secured by any of various means such as by use of adhesives, retainers, plastic deformation, etc.

Fluid tracing materials may include a tracer embedded in a carrier such as a polymer resin. The carrier is a solid and is readily handleable such that it can be placed in a screen in a position to retain the tracer carried therein also in that position. The resin is selected to substantially withstand downhole conditions. The resin can be water soluble, water insoluble, formable in various ways, etc. It may be an advantage to make use of water based resins for the water soluble tracers. One reason for this is that the tracers are more easily distributed into a hydrophilic resin than a hydrophobic resin. If the fluid tracing materials are impregnated to a support, such as a filter cartridge, then the concentration of tracer can be increased relative to the concentration of resin for these secondarily supported installations when compared to unsupported installations, as the support, such as the material of the cartridge, itself protects the resin and provides integrity.

The tracers can offer various operational attributes. They can have selected solubility, a selected mode of detection, a selected response to incorporation in a carrier substrate, etc. Separate tracers exist for hydrocarbons and water, including for high temperature liquids (i.e. steam) vs. lower temperature tracers, for gas/condensate vs oil, etc. A tracer can, therefore, be selected to only be picked up by water and/or hydrocarbon. As such, if it is desired to monitor for water flow separately apart from oil flow, a particular tracer can be employed to only be picked up and carried in water flow but not in oil. Of course, the selection of oil monitoring over water, steam over liquid water, etc. is also possible, as desired.

The tracers can be detectable in various ways. Tracers can be radioactive, non-radioactive, chemically detectable as by use of laboratory or onsite analysis such as by chromatography, for example as by use of gas chromatography, etc.

Tracers can be incorporated into the polymer structure in any of various ways. The tracers, for example, tracers may be mechanically distributed as salt crystals in the polymer matrix, may be chemically incorporated or a combination of both cases may be possible.

The tracers may be picked up by solubilization, erosion, chemical reaction, etc. For example, chemically bound tracers may be released through hydrolyses either as the tracer itself or as derivatives of the tracer when the polymer is exposed to water at high temperature.

The rate of tracer pick up depends on a number of factors including surface area and geometry of that surface exposed to the fluid, fluid temperature, fluid composition, fluid pressure and the mode of tracer infiltration to the carrier.

Generally, tracers that are chemically bound will be released at a slower rate than a tracer that is present as salt particles only. Chemically binding a tracer into the carrier, therefore, extends the lifetime of the tracer source. In cases where a long release period is desirable, a chemically bound tracer/matrix may be preferable to other options.

In one example, fluid tracing materials are obtained from Resman AS (Trondheim, NO). As an example, a fluid tracing material may include a tracer carried in a polymer formed of a melamine formaldehyde (MFR) condensate. The tracer may be mixed into the MFR solution before hardening with a suitable hardener. The condensate solution is commercially available from suppliers such as Dynea ASA, Norway, and is a reaction mixture of melamine, formaldehyde, methanol and water. It may also contain additives such as stabilizers, fillers, plasticizers and/or colorants. In one embodiment, the original content before condensation is 25-40% melamine, 25-35% formaldehyde and 1-10% methanol. The hardener can be formic acid or other products from the supplier. One possible product is Prefere 4720™ with addition of 10% (w/w) of the hardener Prefere 5020™ from Dynea ASA. The condensate solution can also be prepared by mixing dried powder of the condensate with water. The dried powder is available from Dynea ASA or other suppliers and is made by spray drying of a condensate solution with the same original composition of ingredients as listed above, One possible resin powder product is Dynomel M-765™ from Dynea ASA. The tracer may be mixed into the condensate solution using a mechanical blender before the hardener is mixed in. In one embodiment, after embedding the tracer in the carrier material, the material is cured under heat, for example, in a curing oven. The tracer release rate from this MFR/tracer system will depend on the surface and geometry of the MFR exposed to the fluid. The release rate of tracer will further be influenced by parameters such as temperature, fluid composition and pressure. The MER will tolerate a large fraction (in %) of tracer compound and still maintain acceptable mechanical properties. Typical tracer loading will be 5-20 weight %. A standard temperature/pressure range where the MFR system according to the present invention may be used will be up to 120° C. and 600 bar.

Some tracers such as amino naphthalene sulfonic acids and fluorescein will react with formaldehyde and melamine in the condensate solution. The chemical reaction may be enhanced by applying heat. These tracers will be incorporated into the polymer structure after hardening.

Of course, other tracers and substrates may be employed, the foregoing being only an example. Again, these materials should be selected with consideration to the downhole conditions in which the tubular is to be employed.

For example, urea formaldehyde resin was also tested as carrier for the water tracers. This resin type was determined to be much less stable to water at elevated temperatures than MFR.

A more hydrophobic resin like polymethylmethacrylate was also tested as a carrier, but it was more difficult to disperse the tracer particles evenly in the resin.

Of course, other tracers and substrates may be employed, the foregoing being only an example.

In one embodiment, a cartridge or part of a cartridge may be soaked with the liquid polymer+tracer solution to fill the pore space. Thereafter, it can be allowed to cure.

The amount of tracer on any screen can vary. For example, the number of tracer-containing pockets on a joint of screen (typically 40 ft long) may depend on how long tracer-based fluid monitoring is desired. In one embodiment, a typical density is 12 to 52, or 20 to 36 pockets of tracer per foot (DPF) but this density can vary depending on flow rate requirements. In one embodiment, a screen was produced with 32 tracer-embedded discs installed per foot with an equal number of filtered openings and the tracer entrainment was found to be maintainable for at least 6 months. Of course, as with any wellbore tubular it may be necessary to consider any pressure drop created by flow through the screen openings such that fluid flow into or out of the well is not adversely affected.

In one embodiment, two material types are used in each target screen: a water tracing material and an hydrocarbon tracing material. The amount of tracing material installed in the screen may depend on the duration to be monitored and the volumetric flow of the hydrocarbon or water to be monitored.

During manufacture of the tubular, it is possible to suitably place a selected amount and composition of material 8 on the outer surface of the tubular to ensure that appropriate fluid treatment, which is tracer loading, is provided for fluids passing (arrows F) along the outer surface of the tubular, and eventually through the wall of the tubular and through the inner diameter to surface, over a predictable period of time.

The wellbore tubular including the fluid tracer material carried thereon may be placed in a selected position in the wellbore to load tracer into the fluids being produced at that location. Other regions of the well may also have tubulars with tracing material therein, may have solid tubulars therein or may be left open without a tubular string positioned therein, as desired. As such, the fluid tracing materials can be placed specifically where the operator requires them.

Figure 4:
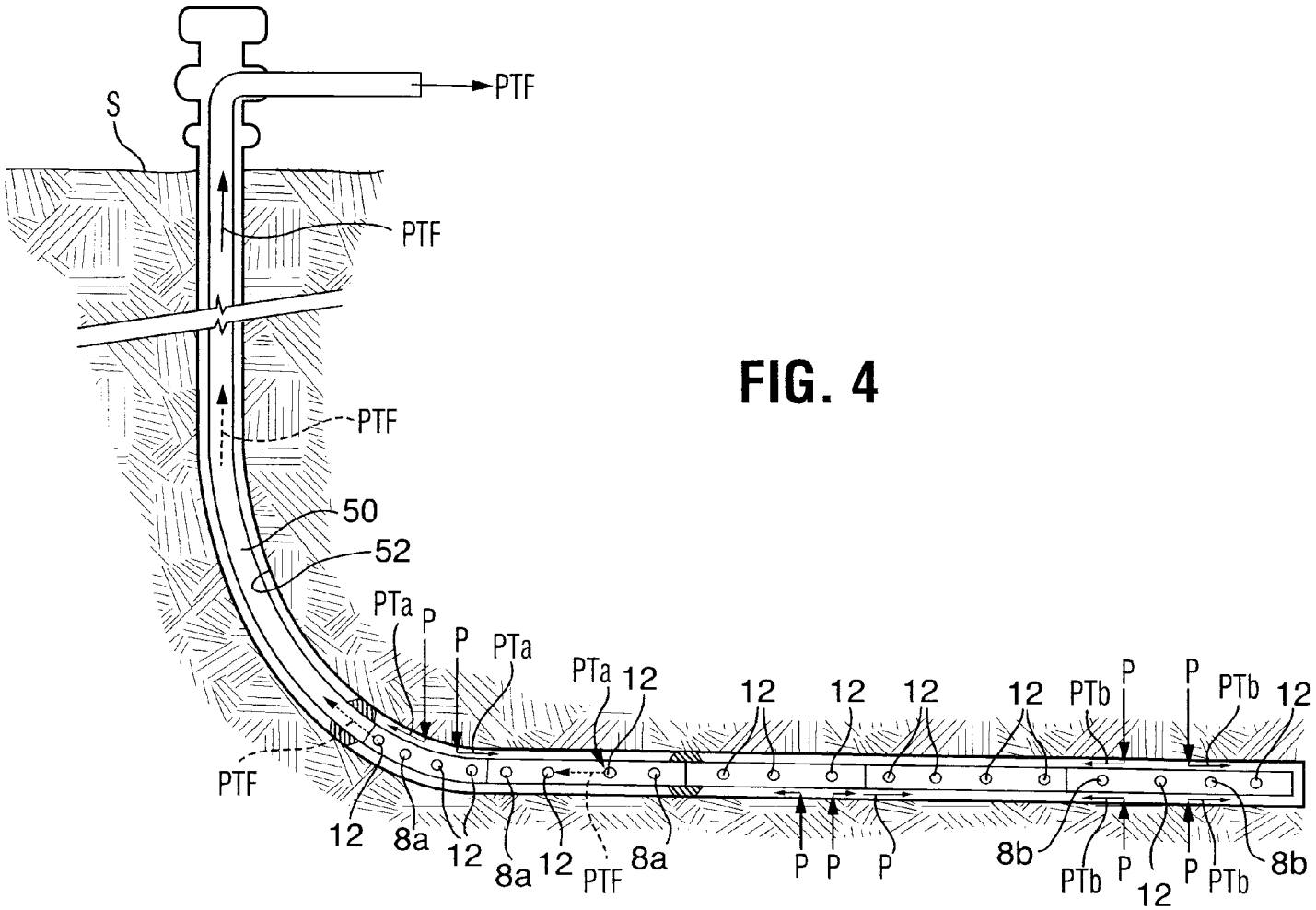
FIG. 4 is a section through a wellbore showing a wellbore string installed therein.

For example, with reference to FIG. 4, in use, a wellbore tubular, such as one of those described above, may be installed in a tubular string 50 and run into a position in a wellbore 52. The wellbore tubular may then be in place to handle the flow of produced fluids (arrows P) flowing from the formation into the wellbore, to load tracer into those produced fluids (arrows PTa, PTb) as they pass along the outer surface and into contact with fluid tracing material 8*a*, 8*b* in pockets on the outer surface (if the fluid being produced is compatible with the tracer) and finally to filter those treated, produced fluids (arrows PTF) as they pass through the filter-material 12 filled openings of the string's perforated wall.

The screen, therefore, provides a monitoring system, wherein a unique tracer can be used that allows individual zones in a well where the screen has been installed to be monitored for amount and/or type of production flow. For example, a plurality of screens can be installed, each having a unique tracer in the fluid tracing material carried thereon. In the illustrated embodiment, for example, the string portion in the heel of the well carries tracer material 8*a*, which releases a tracer Ta, while the string portion in the toe of the well carries a tracer material 8*b*, which releases tracer Tb.

The screens with unique tracers Ta, Tb being installed at known locations in the well allows finds produced through those screens to be monitored as to flow rate and content by observation of the tracer content in the fluid at surface S. The tracers are designed to be released to the target fluid during a certain period that can be hours, days, months or years depending on the monitoring objectives.

Unique tracers may be placed in each zone, or even in each completion string joint to obtain the required downhole resolution. For example, in a well with three zones, at least three different tracers T1, T2, T3, may be used in screens intended for installation one tracer type for each zone. If production arises from all zones, all three tracers T1, T2, T3 are present in the fluid arriving at surface. However, if only one or two of the tracers are detected in the produced fluids at surface, this indicates that one zone is not producing and the location of the non-producing zone is apparent, depending on which tracer is not present in the produced fluids.

The fluid tracing material may be selected to release their tracers to all produced fluids, only hydrocarbon, only water, following after only certain events or over a certain period of time depending on the monitoring objectives.

Samples of the well fluids PTF are taken at surface S for analysis. Commingling of fluid from several zones or wells does not jeopardize the results. Analysis is done and results are available quickly.

Of course, a wellbore string can be employed that includes an amount of material 8 that does not remain active for the full operational life of the wellbore string. In such a case, when it is determined that the tracing materials are spent, for example, that tracer is no longer being detected at surface, it may be decided that the tubular will be left in place and the fluids passing therethrough will simply no longer be monitored by fluid tracing or, alternately, the tubular may be tripped to surface for recharging or replacement or the tubular string may be supplemented by insertion of a smaller diameter string therein with further materials 8 thereon.

Various embodiments of such cartridge-type screens and cartridges for use therein are described in detail herein after with reference to FIGS. 5 to 9.

Figure 5:
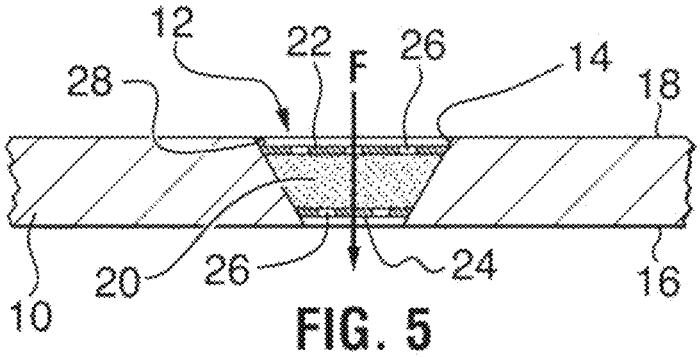
FIG. 5 is a section through a wellbore screen cartridge, with reference to line of FIG. 1 for the sectional location thereof.

With reference to FIG. 5, for example, a filter cartridge 12 useful in a wellbore screen can include a filter media 20. In one embodiment, the filter cartridge can also include one or more retainer plates positioned about the filter media. In one embodiment, as illustrated, the filter cartridge includes an exterior retainer plate 22, an interior retainer plate 24 and filter media 20 contained therebetween. In one embodiment, the exterior retainer plate and the interior retainer plate may be coupled to one another by any of a plurality of methods, such as adhesives, welding, screws, bolts, plastic deformation and so on. In another embodiment, the retainer plates are not secured together but held in position by their mounting in the base pipe.

If used, the exterior retainer plate and the interior retainer plate may contain one or more apertures 26 through which fluid may flow, arrow F. Exterior retainer plate 22 and interior retainer plate 24 may be constructed of any suitable material, such as plastic, aluminum, steel, ceramic, and so on, with consideration as to the conditions in which they must operate.

Filter media 20 of the filter cartridge can be any media, such as including a layer of compressed fiber, woven media, ceramic and/or sinter disk that is capable of operating in wellbore conditions. The filter media must be permeable to selected fluids such as one or more of steam, stimulation fluids, oil and/or gas, while able to exclude oversized solid matter, such as sediments, sand or rock particles. Of course, certain solids may be permitted to pass, as they do not present a difficulty to the wellbore operation. Filter media can be selected to exclude particles greater than a selected size, as desired. The present screen can employ one or more layers or types of filter media. In one embodiment, a filter media including an inner woven screen, an outer woven screen and a fibrous material is used. In another embodiment, a filter cartridge may include a single layer of filter media, as shown in FIG. 4, to facilitate manufacture. Sintered material may be useful as a single layer filter media.

Openings 14 may be spaced apart on the base pipe wall such that there are chambers of solid wall therebetween. The openings extend through the base pipe sidewall and may each be capable of accommodating a filter cartridge 12. The filter cartridges can be mounted in the openings by various methods including welding, threading, etc. In one embodiment, at least some filter cartridges may be installed by taper lock fit into the openings. In such an embodiment, each of the filter cartridge and the opening into which it is to be installed may be substantially oppositely tapered along their depth so that a taper lock fit can be achieved. For example, the effective diameter of the opening adjacent the base pipe's outer surface 18 may be greater than the effective diameter of the opening adjacent inner bore surface 16 and cartridge 12 inner end effective diameter, as would be measured across plate 24 in the illustrated embodiment, may be less than the effective diameter at the outer end of filter cartridge 12 and greater than the opening effective diameter adjacent inner bore surface 16, so that the filter cartridge may be urged into a taper lock arrangement in the opening. In particular, the outer diameter of the filter cartridge can be tapered to form a frustoconical (as shown), frustopyramidal, etc. shape and this can be fit into the opening, which is reversibly and substantially correspondingly shaped to engage the filter cartridge when it is fit therein. In one embodiment for example, the exterior retainer plate may exceed the diameter of the interior retainer plate of the filter cartridge. Of course, the filter cartridge may be tapered from its inner surface to its outer surface in a configuration that is frustoconical, frustopyramidal, and so on and the openings of the base pipe may be tapered correspondingly so that their diameter adjacent the inner bore surface is greater than that adjacent the side wall outer surface, if desired. However, installation may be facilitated by use of an inwardly directed taper, as this permits the filter cartridges to be installed from the base pipe outer surface and forced inwardly.

The filter cartridges may be secured in the base pipe openings by any of various means. For example, in one embodiment, the filter cartridge may be press-fit into the opening of the base pipe. In another embodiment, the filter cartridge may be secured to the opening of the base pipe by an adhesive 28 (for example epoxy), by welding, by soldering, by plastic deformation of the base pipe over the cartridge, by holding or forcing the cartridge into engagement behind a retainer or extension over of the opening and so on, at one or more of the interface points between the filter cartridge and the base pipe. A seal, such as an o-ring, may be provided between the filter cartridge and the opening, if desired.

Figure 6:
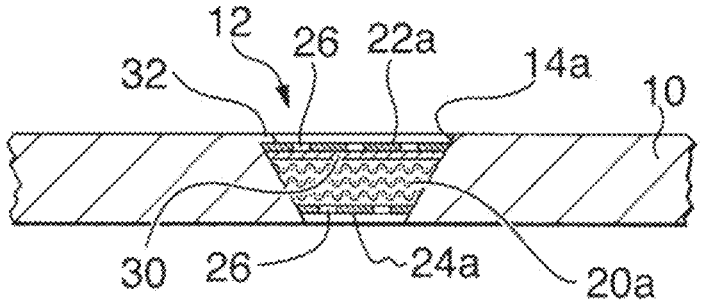
FIG. 6 is a section through another wellbore screen cartridge, the sectional position corresponding to that of FIG. 5.

In a further embodiment as shown in FIG. 6, a wellbore screen may include a selectively openable impermeable layer 30 relative to at least some of the plurality of openings, such as illustrated by opening 14*a*. The impermeable layer can be normally closed and when closed is impermeable to solid matter as well as substantially impermeable to fluid flow, such as any or all of wellbore fluids, drilling fluids, injection fluids, etc. Impermeable layer 30, however, can be selectively opened, as by removal, bursting, etc. of the impermeable layer at a selected time, such as when the screen is in a selected position downhole, such as when it is in a finally installed position.

The impermeable layer may act at one or a plurality of openings to plug fluid flow therethrough. For example, the screen can include an inner or an outer covering on its sidewall that covers a plurality of openings. Alternately or in addition, an impermeable layer can be applied to or incorporated in the filter cartridges. In one embodiment, impermeable layer 30 may be applied on or adjacent exterior and/or interior filter cartridge retainer plates 22*a*, 24*a* or can be incorporated into the filter cartridges, as for example by infiltration into filter media 20*a*. It may be useful to position the impermeable layer such that it is protected against direct contact or to facilitate manufacture. In one embodiment, the impermeable layer can be protected within components of the filter cartridge, as shown. The impermeable layer may serve to cover/block/plug the openings and the filter cartridge in order to prevent the flow of fluid therethrough and/or to prevent access of solids to the filter media, until the impermeable layers are selectively opened.

The impermeable layer may comprise various materials, such as aluminum foil, glass, wax, cellulose, polymers, and so on. The impermeable layer may be opened to permit fluid flow, as by removal or breaking, once the wellbore screen is in position down hole. The method of opening can vary based on the material of the impermeable layer, and may include pressure bursting, impact destruction, and/or removal by solubilization, melting, etc. as by acid, caustic or solvent circulation, temperature sensitive degradation, and so on.

In one application, a wellbore screen including impermeable layers relative to its openings, may be useful to resist plugging of the openings, which can result for example from the rigors of running in. In another application, the impermeable layers are used to selectively allow flow along or from a certain section of the wellbore, while flow is blocked through other openings. In yet another application, a wellbore screen including impermeable layers relative to its openings, may be useful to permit drilling of the screen into the hole, as by liner or casing drilling. In such an application, the impermeable layers can be selected to hold the pressures encountered during drilling, for example, pressures of a couple of hundred psi. In such an embodiment, the impermeable layers will be present to plug the openings at least when the wellbore screen is being run down hole so that the wellbore screen may be drilled directly into the hole. Once the screen is drilled into position, the impermeable layers may be opened, as by bursting with application of fluid pressure above that which the layers can hold.

Depending on the application, it may be useful to seal all of the openings of a wellbore screen or it may be useful to block only certain of the openings, while others are left open. In another embodiment, it may be useful to use selected materials to form the impermeable layers on a first group of openings while another impermeable layer material is used over the openings of a second group so that some openings within a liner, for example those of the first group, can be opened while others, for example the openings of the second group, remain closed until it is desired to remove or break open that impermeable material.

One or more impermeable layers can be used, as desired. The layers may be positioned to provide protection to certain filter cartridge components. For example, where media plugging is a concern the impermeable layer can be positioned to protect against plugging such as by positioning the impermeable layer adjacent exterior retainer plate 22*a* to protect against plugging by external flows or materials. Alternately or in addition, an impermeable layer may be provided between inner retainer plate and the filter media to prevent plugging by flow from inside to outside.

In the illustrated embodiment of FIG. 6, impermeable layer 30 is positioned between exterior retainer plate 22*a* and filter media 20*a* to prevent plugging of the filter media by scraping along the wellbore during run in and by external fluid flows.

It is noted that FIG. 6 also illustrates an embodiment wherein plastic deformation has been used to form a material extension 32 from the base pipe that overlies the outer surface of the filter cartridge to secure the cartridge in opening 14*a*. It is also noted that a filter media 20*a* of multiple layered, woven materials is illustrated.

Figure 7:
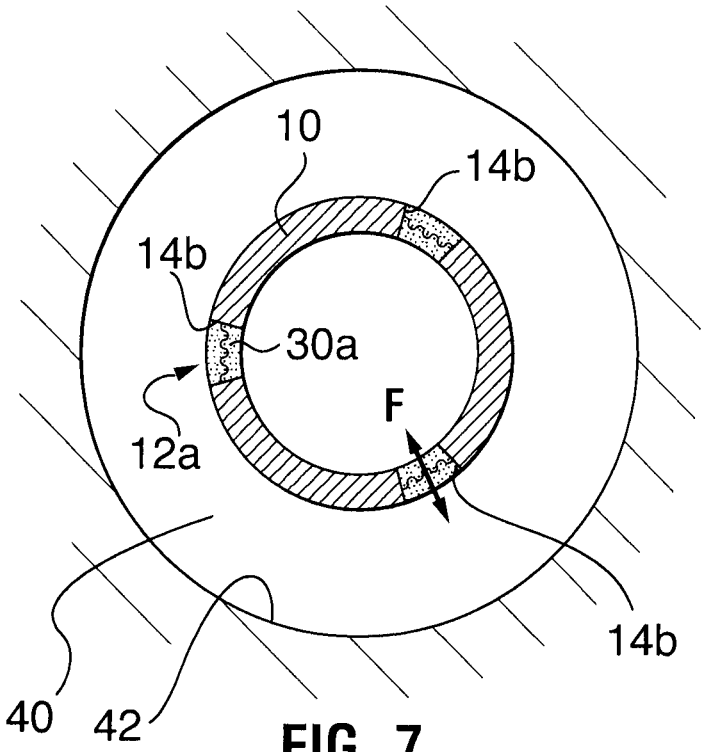
FIG. 7 is a section through another wellbore screen cartridge, the sectional position corresponding to that of FIG. 5.

A wellbore screen, as illustrated in FIG. 7, that is selectively closeable may also be useful where it would be beneficial to run in and/or operate the wellbore screen having open filter cartridges 12*a*, which are later intended to be closed. Such closing may be provided by an impermeable layer associated with the openings of the base pipe 10, the layer being selected to close by a trigger such as for example a chemical such as water or a catalyst, etc. pumped into the well to contact the layer, temperature changes, etc. In one embodiment, an impermeable layer 30*a* may be provided by a chemical agent in a filter cartridge 12*a*. The chemical agent impermeable layer, when it has not yet been triggered, permits fluid flow F through the openings 14*b* in which the filter cartridges and the layer are mounted. However, the impermeable layer of chemical agent acts, when triggered by contact with water, to swell and plug its filter cartridge and opening, for example, by plugging the pores of the filter media.

Figure 8:
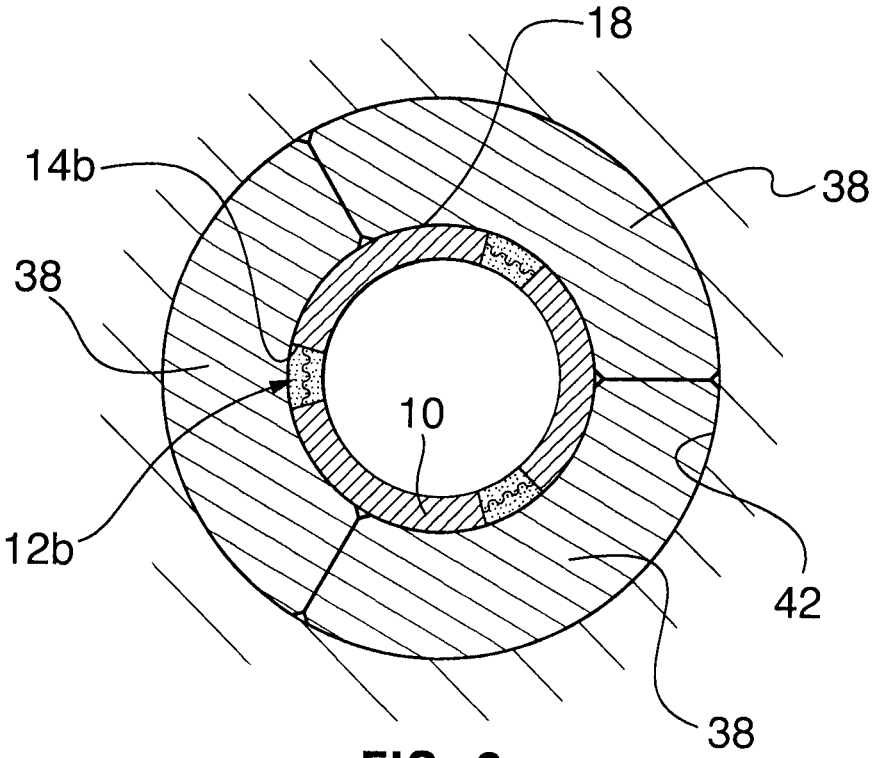
FIG. 8 is an axial section through a wellbore screen.

In another embodiment illustrated in FIG. 8, an impermeable layer associated with the openings, may be selected such that it is normally open but, when triggered, it is capable of swelling to generate impermeable layer material 38 at least beyond the outer surface 18 of the wellbore screen and possibly in the inner bore of the base pipe 10, as well. Sufficient impermeable layer material 38 may be generated during swelling such that the annulus 40 between the screen and the borehole wall 42 may be plugged, thereby preventing flow along the annulus. One application where this would be beneficial is in water shut off operations in uncemented horizontal or vertical wells. In such an application, a liner may be used with wellbore screens installed therein and at intervals along the liner and screens position wellbore screen joints with water shut off cartridges. When triggered the impermeable layer material in the cartridges may swell out of the openings 14*b* to plug the annulus. The plug may prevent the production of water or fluids therepast.

Figure 9:
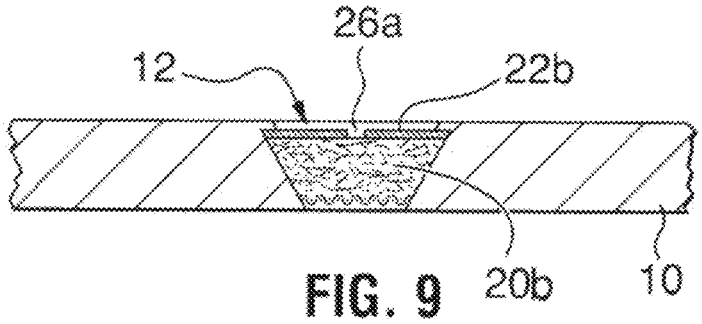
FIG. 9 is a section through another wellbore screen.

With reference to FIG. 9 another embodiment is shown wherein filter cartridge 12*b* is formed to act as a nozzle, as by providing a nozzle component such as for example aperture 26*a* in a retainer plate 22*b*, and includes filter media 20*b*. As such, filter cartridge 12*b* can act to provide sand control and can also have the necessary characteristics to act as a nozzle to vaporize, atomize or jet fluid flow to select injection characteristics. Thus, any fluids introduced through the screen can be shaped or treated to improve contact with the reservoir. In another embodiment, the opening may be formed to act as a nozzle and the filter cartridge may be positioned therein.

Some cartridge-type screens have a double wall construction including an inner wall, an outer wall and a chamber therebetween. Fluid tracing materials may be installed in these screens as well, in the chamber as discussed in applicants aforementioned US Patent or, if tracer contamination of wellbore fluids occurs, on the outer surface, as described hereinbefore.

In addition to fluid tracing materials, other chemical treatment materials may be carried by the screen. Chemical treatment materials can be used to chemically modify the fluid such as, for example, to reduce, as by capturing, eliminating, inactivating, etc., adverse components of the fluid including one or more of heavy metals, sulfur-containing compounds, carbon dioxides, water, plug causing materials (i.e. wax, asphaltenes, bacteria, etc.) or to otherwise improve the fluid's characteristics, such as its viscosity, API gravity, etc. For example, the chemical treatment materials may include any or all of a catalyst, an adsorbent, an absorbent, a solubilizable chemical, a chemically active material such as a reactive metal or magnet, etc. Such chemical treatment materials may include for example, one or more of petroleum refining materials, gas treatments such as sweeteners, desiccants, de-waxing agents or deodorizers, materials for chemically treating water, etc. The chemical treatment materials may be selected to operate in downhole conditions, for example with consideration to conditions such as heat, pressure, the presence of water, aerobic/anaerobic conditions, etc. They may be installed in various locations on the screen such as on the outer surface, in openings and/or, in a double walled screen, in the chamber.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are know or later come to be known to those of ordinary skill in the art are intended to be encompassed by the elements of the claims. Moreover, nothing disclosed herein is intended to be dedicated to the public regardless of whether such disclosure is explicitly recited in the claims. For US patent properties, it is noted that no claim element is to be construed wider the provisions of 35 USC 112, sixth paragraph, unless the element is expressly recited using the phrase "means for" or "step for".

I claim:

1. A cartridge-type wellbore screen comprising: a cylindrical wall including a first end, a second end opposite the first end, an inner surface defining an inner diameter of the wellbore screen, the inner diameter being open from the first end to the second end, and an outer surface; an opening to the inner diameter through the cylindrical wall the opening extending between the outer surface and the inner surface to provide fluid access from the outer surface to the inner diameter; a fluid filtering material positioned to filter particles from passing through the opening; and a fluid tracing material carried by the wellbore screen and mounted at a mounting site spaced from the opening to the inner diameter and outwardly of the inner diameter, the mounting site being positioned such that a fluid flow path is restricted to be from the mounting site, along the outer surface and through the opening before entering the inner diameter, wherein the mounting site is an open topped pocket on the outer surface with walls that initiate at a position flush with the outer surface and extend down into the cylindrical wall and the mounting site includes a closed floor at the base of the walls to stop fluid communication through the mounting site to the inner diameter and the fluid tracing material being located in the open topped pocket and exposed for entrainment to passing fluid over the outer surface.

2. The cartridge-type wellbore screen of claim 1 wherein the first end and the second end are each threaded for connection to adjacent wellbore tubulars.

3. The cartridge-type wellbore screen of claim 1 wherein the mounting site and the opening are similarly formed, except the mounting site includes the closed floor.

4. The cartridge-type wellbore screen of claim 1 wherein the fluid tracing materials include a tracer embedded in a carrier.

5. The cartridge-type wellbore screen of claim 1 wherein the fluid tracing materials are incorporated into a filter cartridge.

6. The cartridge-type wellbore screen of claim 1 wherein the fluid tracing material is for water tracing.

7. The cartridge-type wellbore screen of claim 1 wherein the fluid tracing material is for hydrocarbon tracing.

8. The cartridge-type wellbore screen of claim 1 further comprising a second fluid tracing material and wherein the fluid tracing material is either a hydrocarbon tracing material or a water tracing material and the second fluid tracing material is the other of a hydrocarbon tracing material or a water tracing material.

9. A method for monitoring fluid production in a well, the well extending from ground surface into a formation, the method comprising: installing a cartridge-type wellbore screen in the well, the cartridge-type wellbore screen including a first end, a second end opposite the first end, a cylindrical wall including an inner surface defining an inner diameter of the wellbore screen, the inner diameter being open from the first end to the second end, and an outer surface; an opening through the cylindrical wall providing access between the outer surface and the inner diameter; a fluid filtering material positioned to filter particles from passing through the opening; a fluid tracing material carried by the wellbore screen and mounted at a mounting site, the mounting site being an open topped pocket on the outer surface with walls that initiate at a position flush with the outer surface and extend down into the cylindrical wall and the mounting site includes a closed floor at the base of the walls to stop fluid communication through the mounting site to the inner diameter and the mounting site is spaced from the opening to the inner diameter and outwardly of the inner diameter, the mounting site being positioned such that a fluid flow path is restricted to be from the mounting site along the outer surface and through the opening before entering the inner diameter; allowing a flow of a fluid past the fluid tracing material exposed in the open topped pocket, along the outer surface and through the opening to the inner diameter, the fluid picking up a tracer from the fluid tracing material; allowing the fluid to move through the inner diameter to surface; and monitoring the fluid arriving at surface for the presence of the tracer.

10. The method of claim 9 wherein installing includes connecting the wellbore screen into a tubular string and running the wellbore screen into a position in the well.

11. The method of claim 9 wherein allowing a flow of a fluid includes filtering the flow of the fluid as the flow of fluid passes through the opening, while the tracer remains entrained therein.

12. The method of claim 9 further comprising allowing fluid produced downhole of the screen to pass through the inner diameter without having tracer entrained therein.

13. The method of claim 9 further comprising monitoring the fluid arriving at surface for the presence of a second tracer mounted on the outer surface of another wellbore screen in the well.

14. The method of claim 9 wherein the mounting site is formed as an open topped pocket on the outer surface.

15. The method of claim 9 wherein the fluid tracing materials include a tracer embedded in a carrier.

16. The method of claim 9 wherein the fluid tracing materials are incorporated into a filter cartridge.

17. The method of claim 9 wherein the fluid tracing material is for water tracing.

18. The method of claim 9 wherein the fluid tracing material is for hydrocarbon tracing.

19. The method of claim 9 further comprising a second fluid tracing material on the outer surface and wherein the fluid tracing material is either a hydrocarbon tracing material or a water tracing material and the second fluid tracing material is the other of a hydrocarbon tracing material or a water tracing material.

* * * * *